United States Patent [19]

Näslund et al.

[11] 4,105,389

[45] Aug. 8, 1978

[54] METHOD OF WINDING A TUBE COIL, AND AN ARRANGEMENT FOR PERFORMING SAID METHOD

[75] Inventors: Rolf Paul Näslund, Nyköping; Karl Bertil Åhrbom, Tystberga; Peter Heinrich Erwin Margen, Nyköping, all of Sweden

[73] Assignee: Aktiebolaget Atomenergi, Stockholm, Sweden

[21] Appl. No.: 695,789

[22] Filed: Jun. 14, 1976

[30] Foreign Application Priority Data

Jul. 1, 1975 [SE] Sweden ..... 7507568

[51] Int. Cl.[2] ..... B29C 17/02

[52] U.S. Cl. ..... 425/392; 425/145; 29/157.3 R; 242/77.1

[58] Field of Search ..... 425/145, 392, DIG. 7; 242/77.1, 82; 72/147; 264/281, 285; 29/157.3 R, 157.4

[56] References Cited

U.S. PATENT DOCUMENTS

| | | | |
|---|---|---|---|
| 2,450,324 | 9/1948 | Wilson et al. | 425/DIG. 7 |
| 3,091,407 | 5/1963 | Snyder | 242/77.1 |
| 3,357,484 | 12/1967 | Maher | 29/157.3 R |
| 3,966,387 | 6/1976 | Babbin et al. | 425/392 |

*Primary Examiner*—Michael J. Keenan

*Attorney, Agent, or Firm*—Burns, Doane, Swecker & Mathis

[57] ABSTRACT

A heat exchanger coil is formed by winding a plurality of flexible tubes to form a coil. The turns of the coil are separated in the axial direction of the coil by means of radially disposed separator elements. The turns of the coil are separated in the radial sense by inserting separating means. Said separating means are positively controlled by the radially disposed separating elements relatively to the coil, both in the direction of winding the coil and in the opposite direction. The separating means are locked in the radial direction of the coil by winding the tube over them.

12 Claims, 9 Drawing Figures

METHOD OF WINDING A TUBE COIL, AND AN ARRANGEMENT FOR PERFORMING SAID METHOD

The present invention relates to a method of winding a plurality of flexible tubes to form a coil, at least some of the turns of the coil being separated, considered in the axial direction of the coil, by means of substantially radially disposed spacer elements, and at least some of the turns of the coil being separated in a radial sense by the introduction of spacer means. The present invention likewise relates to an arrangement for performing said method.

In the manufacture of heat-exchanger coils made of flexible tube, one object is to create a certain interval between the tubes of which the coil is made up, this both in the radial and in the axial directions of the coil. For this purpose, hitherto a winding drum has been provided, with radially projecting tube spreaders which space the parallel turns of the tube on the drum during the winding operation. In order likewise to separate the turns of the winding in the radial sense, hitherto spacers have been inserted manually between the turns of the tube coil. To some extend this has been found to be a time-consuming operation and to some extend also it has created difficulties because it has not been possible to make these spacers stay in position.

One object of the present invention, therefore, is to automate the operation of winding in order to overcome the need to manually insert such spacers or axial separating elements. Another object of the invention is to provide a method and a means of positively and automatically controlling the axial spacers relatively to the coil, during the winding operation, thus defining suitable positions for the insertion of axial spacers. Another object of the invention is to provide variable braking of the tube during the winding operation so that the torque acting upon the axle of the drum is maintained substantially constant throughout the whole of the winding operation. The method described introductorily is characterized in that the spacer means are positively controlled by means of the substantially radially (relative to the coil) disposed separating elements, this both in and in opposition to the direction of winding of the coil; and in that the spacer means are locked in the radial direction of the coil by winding the tube over them. In this way, the spacer elements, or elements assigned to them, can be arranged to extract or collect the spacer means item by item from a magazine so that the spacer means, preferably under gravitational effect, move down between the controlling spacer elements into contact with the wound tube. Preferably, at least some of the spacer elements will be arranged in groups of three, of which at least two will be located to one side of a plane which is substantially an axial plane of the coil, whilst the remaining one will be located at the other side of the plane, forming a space in relation thereto, which space corresponds at least to the external dimension of the spacer means.

An arrangement for performing this kind of method when winding a plurality of flexible tubes, preferably tubes made of plastic, on a preferably rotatable drum, in order to form a coil, generally comprises first tube spreaders disposed substantially radially in relation to the drum, in order to separate at least some of the turns of the tube in the axial direction of the coil, second tube spreaders being arranged between at least some of the turns of the coil and substantilly in the axial direction thereof. Commencing from a known arrangement of this kind, the arrangements in accordance with the invention is characterized in that at least some of the first tube spreaders are disposed in groups; in that each group comprises at least three tube spreaders so distributed that they are disposed in two substantially parallel planes extending substantially axially vis a vis the coil; and in that the interval between the tube spreaders located in the two planes is the same as or greater than the thickness of the substantially axially disposed second tube spreaders. In this way, at least some of the rear tube spreaders (considered in the direction of winding) of the group, or one or more elements assigned thereto, can be arranged so that in passing they extract or collect the second tube spreaders item by item from a magazine so that said second tube spreaders can move downwards between the tube spreaders of the group, preferably under the effect of gravity, and into contact with the spiral-wound tube. Conveniently, end plates can be disposed at the end of the coil in order to control the latter, and the inserted second spreaders, in the axial direction. The magazine can be a stacking magazine with a base and an injection opening facing in the direction of winding of the tube. The tube spreaders in the magazine can be spaced towards the ejection opening under gravity or under the control of a spring element, and the base can be constituted by one or more flanges making an angle of somewhat less than 90° with the vertical direction of the stack. The collecting elements or the collecting components for the first tube spreaders can consequently be arranged to move in between the flanges of the base and, due to the rotation of the latter, to feed out the bottommost second tube spreader through the ejection opening.

The invention will be described in more detail in the attached claims.

The invention will be described in greater detail hereinafter, making reference to the attached drawings.

FIG. 1 schematically illustrates an arrangement in accordance with the invention.

Figure 6:
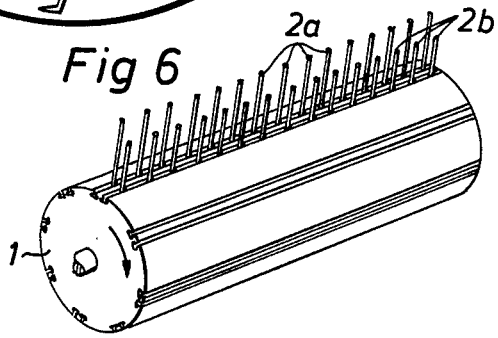

FIG. 6 schematically illustrates the positions of a group of spacers on the drum of the winding arrangement.

Figure 7:
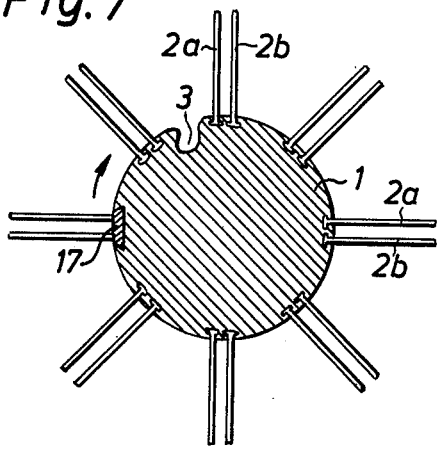

FIG. 7 illustrates an end view of a winding drum with eight groups of radial spacers.

Figure 8:
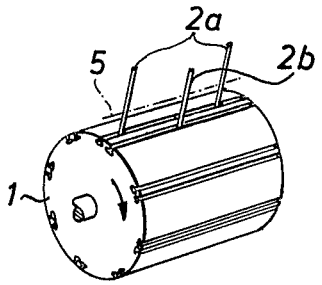

FIG. 8 is a perspective view of the simplest possible arrangement of a group of spacers.

Figure 9:
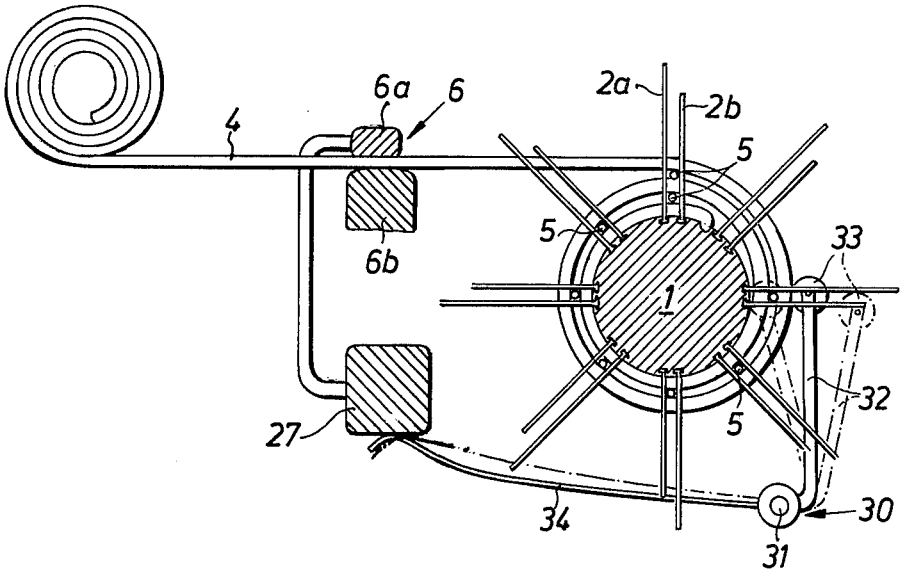

FIG. 9 illustrates an auxiliary arrangement for controlling the braking of the tube during the winding operation.

FIG. 7 illustrates an end view of a winding drum 1 with eight groups of radial tube spreaders 2*a* and 2*b*.

Figure 5:
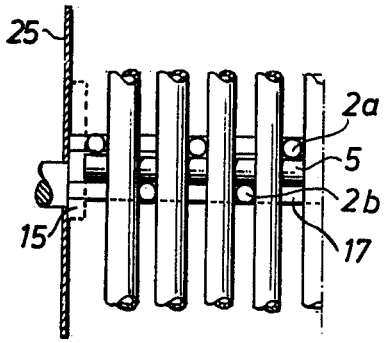
FIG. 5 illustrates a detail of the winding arrangement.

The drum 1 can rotate in the direction of the arrow and exhibits a recess 3 for a manifold tube (not shown). A set of plastic tubes 4 (FIG. 1) for winding to form a coil on the drum 1, is passed through a tube brake 6 and fixed to the manifold tube. The manifold tube is inserted into the recess 3 in the drum. The arrangement of the radial rube spreaders 2*a*, 2*b* in a group, is shown in FIGS. 5, 6 and 8. Preferably, it will be contrived that a radial spacer is disposed on the drum between each tube of the set 4. When the drum 1 rotates, thus the tube set is wound into a plurality of parallel turns of the drum 1. During winding, axial tube spreaders 5 are placed in position between the turns of the winding and consequently in the space between the radial tube spreaders 2*a* and 2*b* in each group of radial tube spreaders. During the winding operation, the brake 6 ensures that the plastic tube is subject to a tension so that the tube acquires a suitable curvature between each group of tube spreaders 2*a*, 2*b*.

The simplest arrangement of tube spreaders 2*a*, 2*b* is shown in FIG. 8 where a group of tube spreaders comprises two rear tube spreaders 2*a* and a front one 2*b* so that the axial tube spreaders 5 can be guided positively between them. Self-evidently, the tube spreaders 2*a* can be designed as two-pronged forks assembled axially upon the external surface of the drum in the manner shown in FIG. 6. The tube spreaders 2*a*, 2*b* can be releasably attached to the external surface of the drum 1, for example by means of some kind of dovetail attachment or the like, so that a finish-wound coil, complete with tube spreaders 2*a*, 2*b*, can be removed from the drum by withdrawing it axially.

Figure 1:
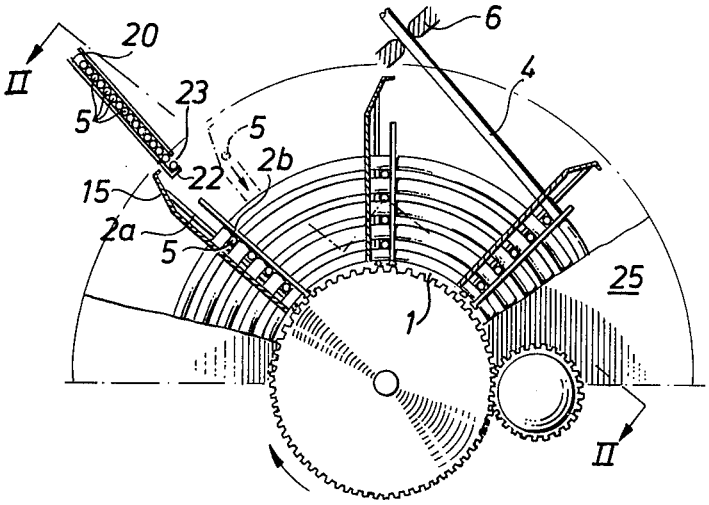
Figure 2:
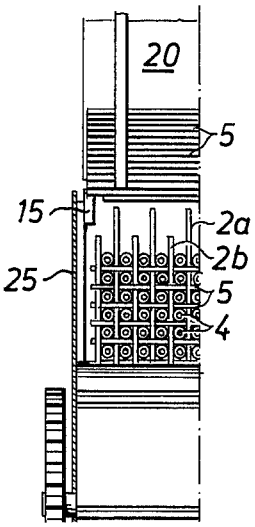
FIG. 2 illustrates a section on the line 2—2 of FIG. 1.

In the manner shown in FIGS. 1 and 2 of the drawing, the drum can be driven by a motor through a gearing arrangement. The winding drum will preferably be equipped with end plates 25 which control the coil and the tube spreaders 5, in the axial direction.

Figure 3:
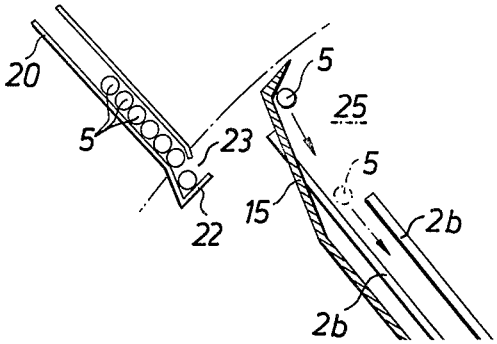
FIG. 3 illustrates a detail of the arrangement of FIG. 1 and shows an arrangement for automatically inserting axial tube spreaders into the coil during winding.
Figure 4:
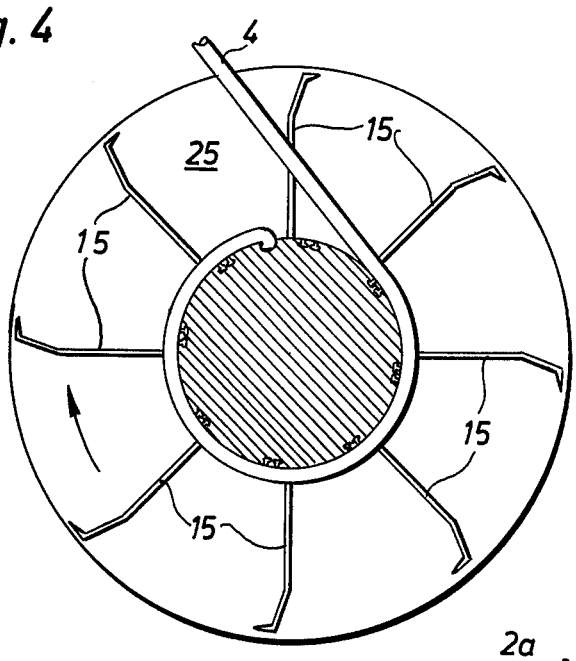
FIG. 4 illustrates a schematic view of an end plate for the winding machine of FIG. 1.

In order to automate the insertion of the tube spreaders 5, the end plates 25 can be provided inside with feed hooks 15 the working ends of which are approximately in a plane extending between the radial tube spreaders 2*a* and 2*b* of each group, and radially beyond the end of the longest radial tube spreader. The hook 15 cooperates with the magazine 20 or tube spreader bars 5. The magazine 20 can be of the stacking kind and be equipped with an ejection opening 23 facing in the direction of rotation of the drum. At the bottom, the magazine 20 exhibits an ejection stop 22 for example in the form of one or more angled flanges, which prevents the bars 5 from leaving the magazine 20 in an uncontrolled fashion. During rotation, the hooks 15 engage outside the flange or flanges 22 and with each pass collect a single bar 5 which can then drop under the gravity down between the radial tube spreaders 2*a* and 2*b* in the manner shown in FIG. 3. The magazine 20 can have an inclination of for example 10 to 170°, preferably around 40°, to the horizontal plane so that the downward feed motion of the bars 5 in the magazine is performed under gravity. The ejection opening of the magazine 20 will preferably be located above a horizontal plane passing through the axle around which the winding drum rotates, and consequently at that side of a vertical plane through the said same axle, at which the collecting hooks 15 perform a rising motion. The tube set 4 wound up to the drum to form the coil, will preferably be arranged at such an angle to the horizontal plane that the point of contact between it 4 and the tube coil is located above a horizontal plane passing through the axle on which the drum rotates. Because of the indicated orientation of the magazine and the placing of the discharge opening thereof in association with the orientation of the tube set 4, no control or feed elements are required in order to feed the bars 5 through the magazine and from there down between the radial bars 2*a* and 2*b* into contact with the tube coil, and the bars 5, once set down, are in stable contact with the coil when the tube set 4 is wound over them. The down-feed hooks 15 can of course also be designed with arms which are secured to the winding drum 1. Alternatively, it is conceivable that the rear tube spreaders 2*a* in each group can be given such a length that they are able to collect a tube spreader 5 from the magazine 20 with each pass. The tube spreaders 2*a* can in this case be equipped with wedge-shape elements corresponding to the external end of the hook 15, in order to ensure correct ejection of the spreaders 5 and to ensure furthermore that they move down properly between the tube spreaders 2*a* and 2*b*. In this embodiment, likewise, it is a good idea to provide end plates 25 on the winding drum, during winding operations, in order to control the bars 5 in the axial direction.

As stated, it is often preferred that the tube spreaders 2*a* or 2*b* are arranged between each turn of the coil so that all the different turns of the tube are laid down at an interval in the axial direction of the coil, which is determined by the dimension of the tube spreaders 2*a*, 2*b*. Likewise, it is often desirable to insert a plurality of tube spreaders 5 between each turn of the coil so that the pitch of the turn is at all times greater than the tube diameter.

The number of groups of radial tube spreader 2*a*, 2*b* can vary within wide limits. When tube spreaders 5 are included in each group of tube spreaders 2*a*, 2*b*, the number of groups is determined by the intended external diameter of the finish-wound coil since it is easier to control the curvature of the tube set between adjacent groups of spreaders 2*a*, 2*b* the shorter the interval between them. The tube spreaders 2*a*, 2*b* as well as any ejection arms 15 can be assembled on a fixing plate 17 in the manner shown in FIG. 5. The fixing plate 17 can be releasably attached to the drum 1 so that a finish-wound coil, together with the spacers 2*a*, 2*b* and possibly the plate 17, can be withdrawn axially from the drum 1 when one of the plates 25 has been removed. The fixing plate 17 can consequently form an assembly element for permanent end plates on the finish-wound heat-exchanger coil. When the coil has been wound a number of turns to give the desired thickness, the tube set 4 is parted off and fixed into an external manifold tube.

In accordance with an alternative preferred embodiment, the end plates 25 will constitute the permanant end plates or end covers of the heat-exchanger coil. In this case, one end plate is provided with a central opening whilst the other is solid. This arrangement is intended so that in operation the air which is to be heated or cooled can be blown into the central opening in the coil whence it flows out substantially radially through the coil, the medium carried within the coil itself flowing inwards, towards the coil centre. The end plates 25 can be assembled on fixing plates 17 and the opening in one end plate will conveniently be the same size as the one in the drum 1 so that a finished control structure comprising plates 17, end plates 25, arms and pins 2*a*, 2*b* can simply be slid onto the drum 1, and so that this structure complete with the tube ultimately wound onto it, can readily be withdrawn from the drum 1 by a simple axial displacement.

If it is intended to assemble the end plates 25 afterwards, it is a good idea to supplement the ejection arms 15 with control plates (see FIG. 3) at the ends of the fixing plate, in order to secure the axial position of the bars 5 during winding.

The coil completed in this way can be held together radially by means of the tube spreaders 2*a*, 2*b* which can be attached to retaining elements disposed axially outside and inside the coil. In the case where the tube spreaders 2a, 2b are assembled on a fixing plate 17, it is sufficient to assemble external retaining elements on just some of the external ends of the tube spreaders 2a, 2b. The tube spreaders 2a, 2b can then be trimmed so that they do not project beyond the tube coil. In FIG. 1 for example, it is illustrated how the rear (considered in the direction of rotation) tube spreaders 2a can extend further away from the coil than those 2b. This preferred difference in length, albeit not essential, is intended to create a larger entry opening between the tube spreaders 2a, 2b in each group, than would be created if the tube spreaders 2a, 2b were of identical length in which case the entry opening between them, for the bars 5, would be approximately the same as the external dimension of the bars 5. The angle of the tube set 4 in relation to the coil will preferably be arranged in accordance with the principle outlined earlier on but may of course differ from this. For example, it is sufficient if the tube set 4 and the group of tube spreaders 2a, 2b together with the coil, form compartments in which the tube spreaders 5 is enclosed when the group of tube spreaders 2a, 2b in which a bar 5 is inserted, without the tube being wound over it, passes the horizontal and inclines downwards so that the bar 5 begins to roll radially outwards from the coil. In this fashion, the point of contact between the coil and the tube set 4 can be brought to a position below a horizontal plane through the axle about which the drum rotates, without any special control elements being required in order to hold the bars 5 in position before the tube set 4 is wound over them.

Self-evidently, the magazine 20 can be spring-loaded in order to feed the bars 5 towards the opening 23, in a situation where it is not wished to impose any particular limitations as far as the angular disposition of the magazine 20 is concerned. Of course, too, the opening 23 of the magazine 20 can be arranged below the horizontal plane passing through the axle about which the drum 1 rotates, if special guide rails are provided for the bars 5 so that the latter cannot roll out from the space between the tube spreaders 2a, 2b in each group, as long as the group is located below the horizontal plane passing through the axle of the drum 1. This kind of control element can consist of one or two bent wires or the like which ensure that the bars 5, moving from the ejection opening 23 of the magazine 20 to a position above the horizontal plane passing through the axle around which the drum 1 rotates, are held readily inside the external end of the tube spreaders 2a, in that group of spreaders 2a, 2b into which the bar 5 is intended to be inserted.

The tube set 4 can of course consist of two or more angularly offset narrower sets in order to simplify the arrangement of the tube magazine for the different tubes, in an adjacent position.

FIG. 9 schematically illustrates a winding arrangement in accordance with the invention, in which the braking system 6 is assigned an element 30 which detects the external dimension of the coil and on the basis thereof controls the braking force of the system 6. The object of braking or tensioning the tube 4 during winding is to ensure a certain radius of curvature on the part of the tube between adjacent groups of bars 2a, 2b, so that the resultant coil, if required, is given a substantially circular external shape. During the winding operation, the diameter of the coil increases and generally the radius of curvature of the tube increases with it. By means of the element 30, the braking force is reduced with increasing external dimension on the part of the coil, which means that the tube or tube set at all times acquires a substantially circular curvature, relatively to its centre, between adjacent groups of bars 2a, 2b. Furthermore, the braking torque acting on the axle of the winding drum is maintained substantially constant throughout the winding operation.

This kind of braking arrangement 6 controlled by the radius of the coil, can in principle be designed in the manner shown in FIG. 9. The brake 6 can comprise a stationary brake pad 6b and a moving brake pad 6a. The brake pad 6a is influenced by a weight 27 which presses the brake pad 6a against pad 6b so that the tube set 4 is braked by a clamping or friction effect. The weight 27 is itself influenced by the element 30. The element 30 comprises a stationary bearing stub 31 on which lever, for example a bellcrank lever, is pivotally assembled. The lever has two arms 32 and 34 one of which is preferably spring-loaded. The arm 32 is provided at one end with a follower roller 33 which is in contact with the tube coil. As the radius of the coil increases, the roller 33 is moved outwards relatively to the coil so that the lever rotates on the stub 31 and the arm 34 applies a force to the weight 27 in the upward direction so that the clamping force between the brake pads 6a, 6b is reduced. Because one of the arms 33, 34 is designed as a spin, a very gentle reduction in braking force is produced which is relatively insensitive to small disturbances in the movement of the roller 33.

It should be clearly understood, however, that the brake 6 and the element 30 can quite readily be modified or designed in a different way within the context of the inventive idea. For example, the arm 34 can be directly coupled to one end of a compression or tension spring which forces the brake pad 6a into contact with that 6b. Alternately, of course, the roller 33 can be connected to some conventional positional detector element or the like, which produces control signals for some kind of conventional brake 6 which, under the control of the signals, produces the desired above indicated brake action to the tube 4.

We claim:

1. Apparatus useful for spiral winding of a plurality of flexible tubes in order to form a multiple tube coil, comprising:

(a) a drum;

(b) means for rotating the drum;

(c) first tube spreaders extending substantially radially relative to the drum, for separating at least some adjacent single tube spirals in the axial direction of the drum, at least some of said first tube spreaders being arranged in groups, each of said groups comprising at least three tube spreaders disposed in two substantially parallel planes, said planes extending substantially axially relative to said drum; and (d) means for inserting second tube spreaders in parallel with the drum axis between at least some adjacent spiral tubes and between the first tube spreaders of a group, the interval between the first tube spreaders of the group located in two planes being not less than the thickness of a second tube spreader.

2. Apparatus according to claim 1 wherein at least one collector means is assigned to the trailing first spreader of the group, considered in the rotational direction of the drum, said collector means being arranged to extract a second tube spreader from a magazine for second tube spreaders in passing said magazine, whereby the second tube spreader moves down, under gravity, between the first tube spreaders of a group into contact with the spirally wound tube coil and is interlocked in such position by the next-following spiral turn.

3. An apparatus as claimed in claim 1 wherein end plates are arranged at the ends of the drum in order to axially guide the tube coil and the inserted second tube spreaders.

4. An apparatus as claimed in claim 2, wherein the magazine is a stacking magazine having a base and an ejection opening facing in the direction of rotation of the tube coil.

5. An apparatus as claimed in claim 1, wherein a braking system is arranged to perform a variable braking or tensioning action on the tubes during the winding operation, such that the axle on which the drum rotates experiences a substantially constant braking torque irrespective of the instantaneous diameter of the coil.

6. An apparatus as claimed in claim 5, wherein the braking system is controlled by a detector means which detects the instantaneous radius of the tube coil.

7. An apparatus as claimed in claim 6, wherein the detector means comprises a pivotally mounted lever, one arm of said lever being equipped with a follower roller in contact with the tube coil, while the other arm thereof is designed to reduce the braking effect of the braking system, as the diameter of the tube coil increases.

8. An apparatus as claimed in claim 6, wherein the braking system comprises a stationary brake pad, a moving brake pad, and a weight connected to said moving brake pad, said weight forcing the moving pad towards the stationary pad, the detector means being connected to and influencing the moving weight.

9. An apparatus as claimed in claim 7, wherein one arm of the lever is designed as a resilient spring member.

10. An apparatus as claimed in claim 1 wherein the first tube spreaders are removably fastened on the drum.

11. An apparatus as claimed in claim 7 wherein the lever is a bellcrank lever.

12. An apparatus as claimed in claim 9 wherein one arm of the lever constitutes a leaf spring.

* * * * *